US009563223B2

(12) United States Patent
Bai et al.

(10) Patent No.: US 9,563,223 B2
(45) Date of Patent: Feb. 7, 2017

(54) LOW-VOLTAGE CURRENT MIRROR CIRCUIT AND METHOD

(71) Applicant: Avago Technologies General IP (Singapore) Pte. Ltd., Singapore (SG)

(72) Inventors: Dezhao Bai, Sunnyvale, CA (US); Faouzi Chaahoub, San Jose, CA (US)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 14/715,638

(22) Filed: May 19, 2015

(65) Prior Publication Data

US 2016/0342172 A1 Nov. 24, 2016

(51) Int. Cl.
*G05F 3/26* (2006.01)

(52) U.S. Cl.
CPC ..... *G05F 3/267* (2013.01)

(58) Field of Classification Search
CPC ..... G05F 3/26; G05F 3/267
USPC ..... 323/215
See application file for complete search history.

(56) References Cited

U.S. PATENT DOCUMENTS 4,629,913 A * 12/1986 Lechner ..... H03K 19/01812 323/316
5,847,556 A * 12/1998 Kothandaraman ..... G05F 3/262 323/315
6,657,481 B2 12/2003 Rasmussen et al.
6,791,307 B2 9/2004 Harrison
7,746,047 B2 * 6/2010 Yin ..... G05F 1/575 323/273
7,960,959 B2 * 6/2011 Missoni ..... H03G 1/0017 323/312
8,717,092 B1 5/2014 Antunes Ribafeita et al.
2003/0067291 A1 * 4/2003 Hong ..... G05F 3/30 323/315
2009/0315618 A1 12/2009 Hashimoto
2011/0018621 A1 1/2011 Butzmann
2015/0001938 A1 * 1/2015 Fort ..... H02M 1/08 307/52

FOREIGN PATENT DOCUMENTS

EP 2375565 A1 12/2011

* cited by examiner

*Primary Examiner* — Jeffrey Sterrett

(57) ABSTRACT

A current mirror circuit is provided that has a feedback loop that includes a current mirror that provides base current compensation to the bases of the input and output transistors of the current mirror circuit. By employing a current mirror in the feedback loop to provide base current compensation, the minimum power supply voltage of the current mirror circuit is very low, typically less than or equal to about 1.5 V.

27 Claims, 6 Drawing Sheets

LOW-VOLTAGE CURRENT MIRROR CIRCUIT AND METHOD

TECHNICAL FIELD

The invention relates to current mirror circuits, and more particularly, to a current mirror circuit having a relatively low power supply voltage.

BACKGROUND

A current mirror circuit is a circuit that mirrors, or copies, the current flowing in one active device of the circuit in another active device of the circuit while keeping the output current of the circuit constant regardless of the output load. A wide variety of current mirror circuits exist. FIG. 1 illustrates a block diagram of basic bipolar junction transistor (BJT) current mirror circuit. Ideally, the output current Iout is equal to the input current Iref times the ratio of $Q_2/Q_1$. However, the base currents of BJTs $Q_1$ and $Q_2$ are also drawn from Iref, which reduces the effective Iref. As a result, the output current Iout is smaller than expected. When BJT $Q_2$ is large, or there are a greater number of output transistors connected in parallel, the error of Iout is significantly large.

FIG. 2 illustrates a block diagram of a BJT current mirror circuit that employs a third BJT $Q_3$ to perform base current compensation. With the exception that the base current of BJT $Q_3$ is drawn from the input current Iref, all base currents come from the emitter of BJT $Q_3$ so that the Iout error is almost negligible. The feedback loop stability is compensated by capacitor $C_f$. However, the minimum power supply voltage, $V_{DD}$, has to be greater than two times of the bipolar base-emitter voltage plus the saturation voltage of the current source Iref. In general, the power supply voltage $V_{DD}$ should be greater than ~2.2 V. Therefore, this circuit generally is not suitable for low voltage (i.e., less than about 1.8 volt (V) operation.

FIG. 3 illustrates a block diagram of a current mirror circuit that employs an N metal oxide semiconductor field effect transistor (NMOS) to perform base current compensation. The BJT $Q_3$ shown in FIG. 2 is replaced by NMOS $M_3$ in FIG. 3. The NMOS transistor does not draw any current from input current Iref, and therefore there is no Iout error caused by base currents. As in the circuit of FIG. 2, the feedback loop stability in the circuit of FIG. 3 is compensated by capacitor $C_f$. All base currents are provided by NMOS $M_3$. The minimum power supply voltage $V_{DD}$ needs to be greater than the bipolar base-emitter voltage plus the gate-source voltage of NMOS $M_3$ plus the saturation voltage of the current source Iref. The result is similar to the above one in that this circuit is also not suitable for low voltage (i.e., less than about 1.8 V) operation.

Accordingly, a need exists for a current mirror circuit that is capable of low-voltage operation.

DETAILED DESCRIPTION OF ILLUSTRATIVE EMBODIMENTS

Figure 1:
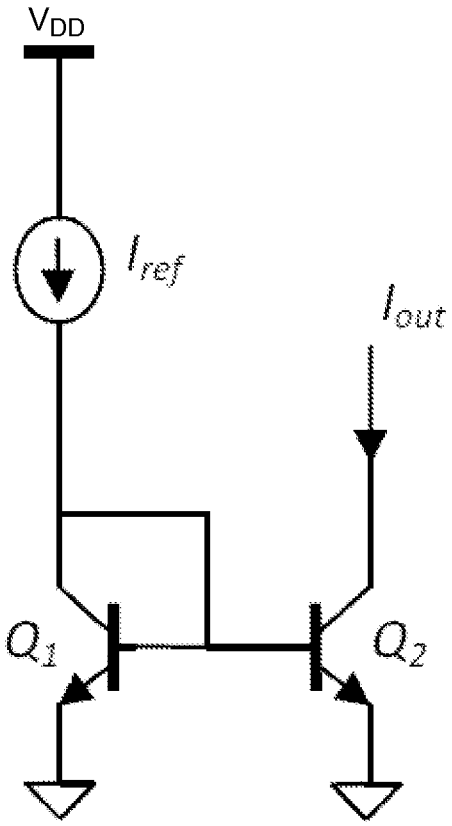
FIG. 1 (PRIOR ART)
FIG. 1 illustrates a block diagram of known basic BJT current mirror circuit.
Figure 2:
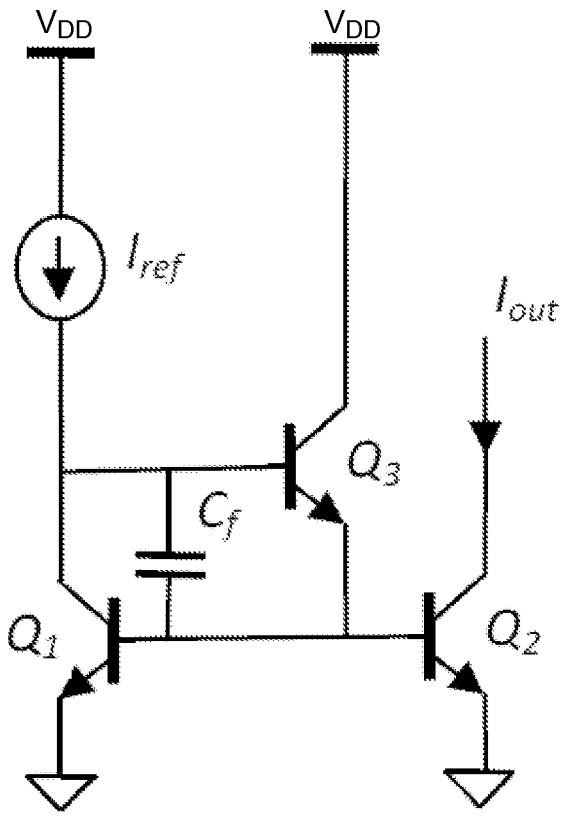
FIG. 2 (PRIOR ART)
FIG. 2 illustrates a block diagram of a known BJT current mirror circuit that employs a third BJT to perform base current compensation.
Figure 3:
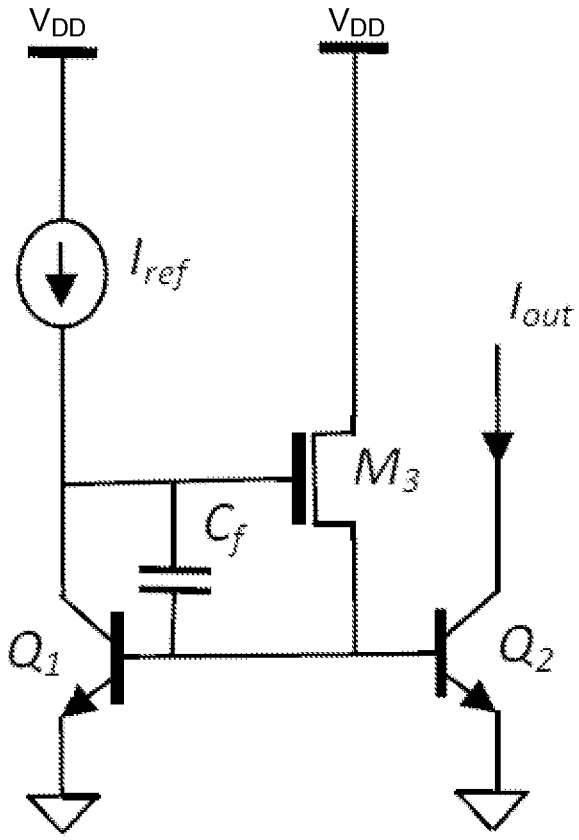
FIG. 3 (PRIOR ART)
FIG. 3 illustrates a block diagram of a known current mirror circuit that employs an NMOS to perform base current compensation.

A current mirror circuit is provided that has a feedback loop that includes a current mirror that provides the base current compensation for BJTs $Q_1$ and $Q_2$. By employing a current mirror in the feedback loop to provide base current compensation, the minimum power supply voltage, $V_{DD}$, of the current mirror circuit can be less than or equal to about 1.5 V. Illustrative, or exemplary, embodiments will now be described with reference to FIGS. 4-6, in which like reference numerals represent like elements, components or features.

Figure 4:
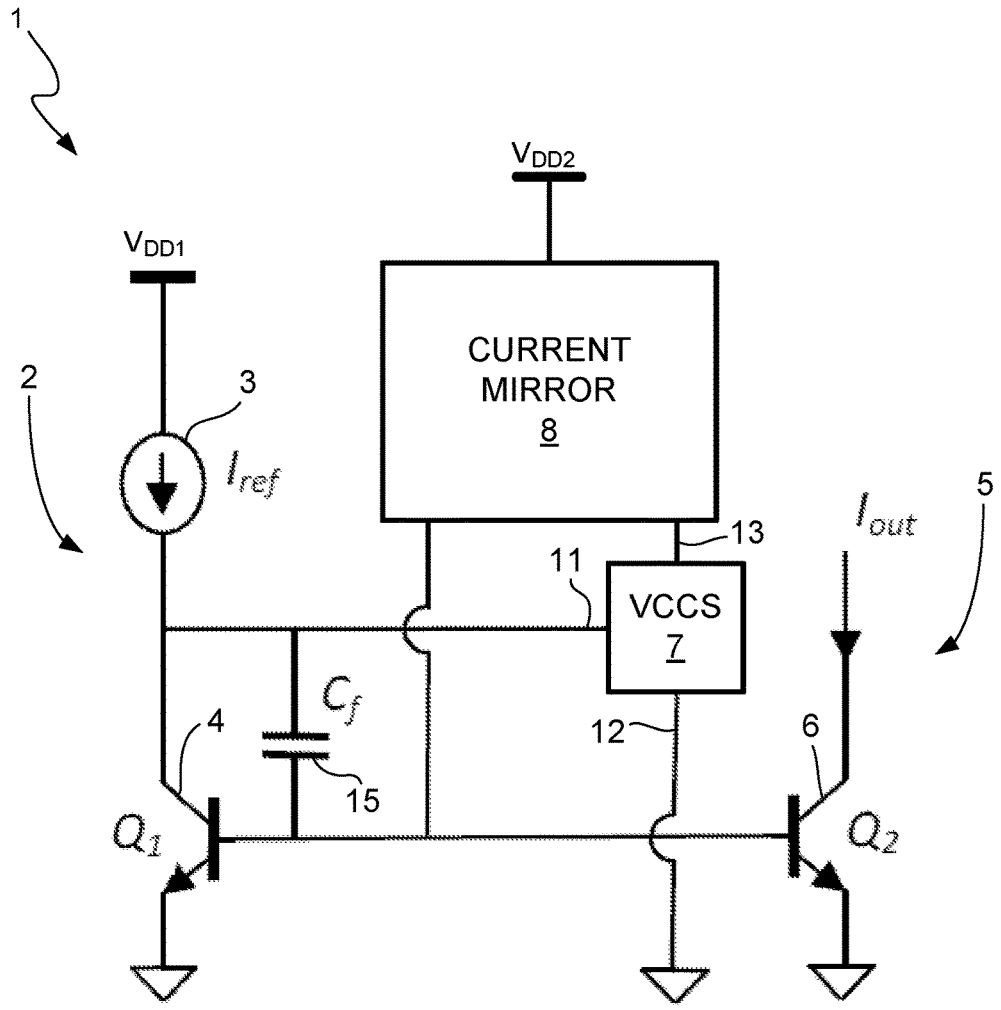
FIG. 4 illustrates a block diagram of the current mirror circuit in accordance with an illustrative embodiment of the invention.

FIG. 4 illustrates a block diagram of the current mirror circuit 1 in accordance with an illustrative embodiment. An input stage 2 of the current mirror circuit 1 comprises a first power supply voltage source, VDD1, an input current source 3 and a first BJT $Q_1$ 4. An output stage 5 of the current mirror circuit 1 comprises at least a second BJT $Q_2$ 6. The output stage 5 may comprise multiple BJTs being driven by the circuit 1 and yet remain capable of operating with a low power supply voltage.

The bases of the first and second BJTs $Q_1$ 4 and $Q_2$ 6 are electrically coupled together. A feedback loop of the current mirror circuit 1 comprises a three-terminal device 7 and a current mirror 8. The three-terminal device 7 has a first terminal 11 that is electrically coupled to a collector of the first BJT $Q_1$ 4, a second terminal 12 that is electrically coupled to ground and a third terminal 13 that is electrically coupled to the current mirror 8. The current mirror 8 is electrically coupled to a second power supply voltage, $V_{DD2}$, which may be the same as or different from the first power supply voltage $V_{DD1}$, and to the bases of the first and second BJTs $Q_1$ 4 and $Q_2$ 6. A feedback capacitor $C_f$ 15 is electrically coupled between the first terminal 11 of the three-terminal device 7 and the bases of the first and second BJTs $Q_1$ 4 and $Q_2$ 6 for providing feedback loop stabilization.

The three-terminal device 7 operates as a voltage controlled current source (VCCS) with a gain (i.e., a transconductance), $g_m$. A variety of three-terminal devices are capable of operating as a VCCS and are suitable for use as device 7, as will be described below in more detail. In the real world, all VCCSs have an output voltage range. The three-terminal device 7 has a minimum output voltage corresponding to the voltage difference between terminals 12 and 13 ($V_{13}-V_{12}$) that is as small as approximately 0.5 V. Typically, the output voltage $V_{13}-V_{12}$ is in the range of approximately 0.5 V to 0.7 V. A few examples of devices that meet these criteria are described below with reference to FIGS. 5 and 6. The minimum power supply voltage, $V_{DD2min}$, is given as: $V_{DD2min}=(V_{13}-V_{12})\min+(V_{DD2}-V_{13})\min$. In most cases, for a device that meets the criteria given above, the minimum power supply voltage $V_{DD2min}$ will be approximately 1.0 V.

For the first BJT $Q_1$ 4, the voltage difference between the collector and the emitter is determined by the voltage at terminal 11, $V_{11}$, of the three-terminal device 7. The voltage $V_{11}$ can be as small as approximately 0.5 V to 0.7 V. The minimum power supply voltage, $V_{DD1min}$, is given as: $V_{DD1min}=(V_{DD2min}-V_{11min})$. In most cases, for a device that meets the criteria given above, the minimum power supply voltage $V_{DD1min}$ will be approximately 1.0 V to 1.2 V. The minimum power supply voltage for the current mirror circuit 1 is the larger of $V_{DD1min}$ and $V_{DD2min}$ plus a reasonable margin, which may be expressed as Max($V_{DD1min}$, $V_{DD2min}$)+margin. For the current mirror circuit 1 shown in FIG. 4, the minimum power supply voltage for the current mirror circuit 1 determined in this manner is less than or equal to about 1.5 V. For example, assuming that $V_{DD2min}$ is about 1.0 V and $V_{DD1min}$ is about 1.2 V, then the minimum power supply voltage for the current mirror circuit 1 would be calculated as $V_{DD}$=Max(1.0 V, 1.2 V)+margin=1.2 V+margin. Assuming that 0.3 V is a reasonable margin, the minimum power supply voltage for the circuit 1 could easily be kept equal to or less than 1.5 V.

Figure 5:
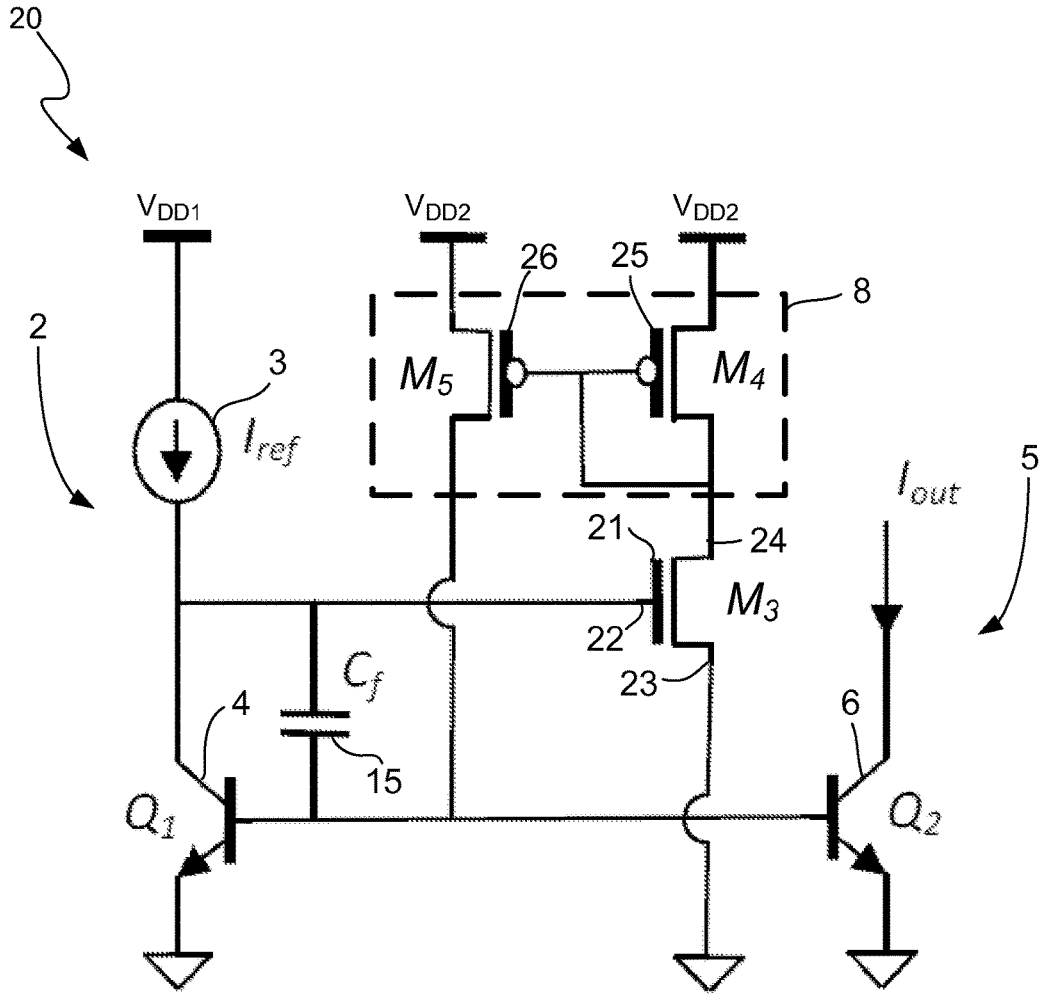
FIG. 5 illustrates a block diagram of the current mirror circuit in accordance with another illustrative embodiment of the invention.

FIG. 5 illustrates a block diagram of the current mirror circuit 20 in accordance with another illustrative embodiment. In accordance with this illustrative embodiment, the three-terminal device 7 shown in FIG. 4 is an NMOS $M_3$ 21. The first, second and third terminals 11, 12 and 13 of the three-terminal device 7 shown in FIG. 4 correspond to the gate 22, source 23 and drain 24 of the NMOS $M_3$ 21 shown in FIG. 5, respectively. The current mirror 8 of the feedback look comprises a first PMOS $M_4$ 25 and a second PMOS $M_5$ 26 that have their bases electrically coupled together and electrically coupled to the drain 24 of the NMOS $M_3$ 21. The drain of PMOS $M_4$ 25 is also electrically coupled to the drain of the NMOS $M_3$ 21. The drain of PMOS $M_4$ 26 is electrically coupled to the bases of the first and second BJTs $Q_1$ 4 and $Q_2$ 6.

The NMOS $M_3$ 21 has a minimum output voltage corresponding to the voltage difference between the drain 24 and source 23, Vds, that may be as small as approximately 0.5 V. Typically, Vds for NMOS $M_3$ 21 is in the range of approximately 0.5 V to 0.7 V. Typically, the voltage difference between gate 22 and source 23, Vgs, is as small as approximately 0.8 V. The minimum power supply voltage, $V_{DD2min}$, is given as $V_{DD2min}=V_{dsmin}$ ($V_{DD2}$−Vd)min. In most cases, the minimum power supply voltage $V_{DD2min}$ for circuit 20 will be approximately 1.0 V.

For the first BJT $Q_1$ 4, the voltage difference between the collector and the emitter is determined by the gate voltage, Vg, of the NMOS $M_3$ 21. Vg is typically in the range of approximately 0.5 V to 0.7 V. The minimum power supply voltage, $V_{DD1min}$, is given as: $V_{DD1min}$=Vgmin+($V_{DD2}$−Vg) min. In most cases, the minimum power supply voltage $V_{DD1min}$ will be in the range of approximately 1.0 V to 1.2 V. The minimum power supply voltage for the current mirror circuit 20 is the larger of $V_{DD1min}$ and $V_{DD2min}$ plus a margin, as described above with reference to FIG. 4. For the current mirror circuit 20 shown in FIG. 5, the minimum power supply voltage for the current mirror circuit 1 determined in this manner is less than or equal to about 1.5 V.

Figure 6:
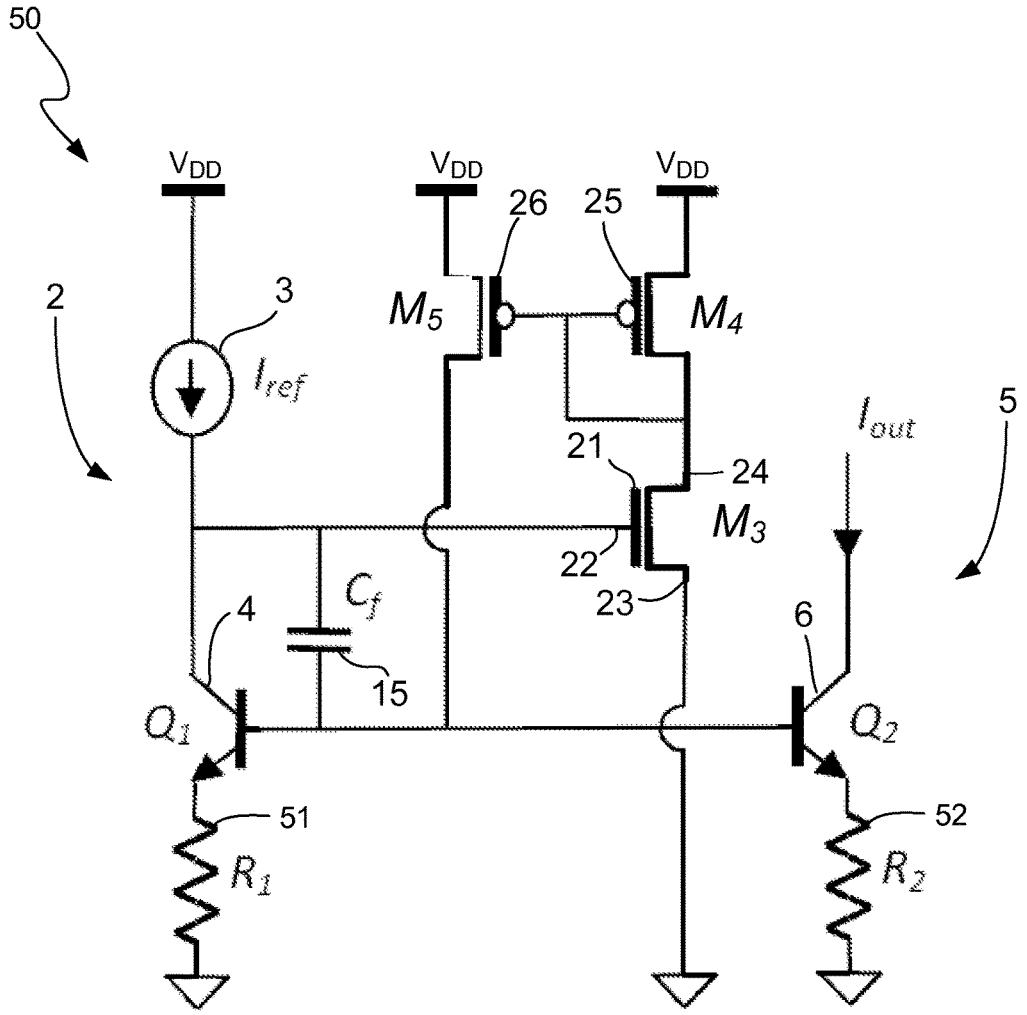
FIG. 6 illustrates a block diagram of the current mirror circuit in accordance with another illustrative embodiment of the invention.

FIG. 6 illustrates a block diagram of the current mirror circuit 50 in accordance with another illustrative embodiment. Like the illustrative embodiment described above with reference to FIG. 5, in accordance with this illustrative embodiment, the three-terminal device 7 shown in FIG. 6 is an NMOS $M_5$ 21 and the current mirror of the feedback loop comprises the PMOS s $M_4$ 25 and $M_5$ 26. The only difference between the current mirror circuits 20 and 50 shown in FIGS. 5 and 6 is that the first and second BJTs $Q_1$ 4 and $Q_2$ 6 have degeneration resistors $R_1$ 51 and $R_2$ 52 connected in between their respective emitters and ground. In all respects, the current mirror circuit 50 operates in the same manner described above with reference to FIGS. 4 and 5 to ensure that the circuit 50 will have a minimum power supply voltage $V_{DD}$ that is less than or equal to about 1.5 V.

The resistors $R_1$ 51 and $R_2$ 52 degenerate the gain of the first and second BJTs $Q_1$ 4 and $Q_2$ 6 to reduce an error that can occur in the output current Iout due to a mismatch in the gains. Assuming that the BJTs $Q_1$ 4 and $Q_2$ 6 have identical physical characteristics, then for a given base-to-emitter voltage, Vbe, they will have identical output currents. If, however, there is a mismatch between their physical characteristics, the output currents will not be the same. If, for purposes of discussion, the BJTs $Q_1$ 4 and $Q_2$ 6 are modeled as VCCSs having gain $g_m$, the output current is given as: Tout=Vbe $\bullet g_m$, where "•" represents a multiplication operator. When there is a mismatch, the effective Vbe of the BJTs $Q_1$ 4 and $Q_2$ 6 become different such that the output currents Iout1 and Iout2, respectively, also become different. For BJT $Q_1$ 4, the output current Iout1=Vbe1 $\bullet g_{m1}$. For BJT $Q_2$ 6, the output current Iout2=Vbe2 $\bullet g_{m2}$. Thus, the difference between these output currents, Iout1−Iout2=($g_{m1}$ •Vbe1)−($g_{m2}$•Vbe2).

Assuming that there is some difference between Vbe1 and Vbe2, the only way to reduce the difference between the input currents Iout1 and Iout2 is to reduce gm. Electrically coupling the resistors $R_1$ 51 and $R_2$ 52 in between the emitters of the BJTs $Q_1$ 4 and $Q_2$ 6 and ground reduces $g_m$. The reduced $g_m$, $g_m'$, is given as:

$g_m'=g_m/(1+g_m \bullet R)$. The difference between the output currents Iout1 and Iout2 is given as: Iout1−Iout2=(Vbe1−Vbe2) $\bullet g_m'$. The effect of a mismatch is reduced by a factor of $1/(1+g_m \bullet R)$.

It will be understood by persons of skill in the art in view of the description provided herein that many modifications may be made to the current mirror circuits 1, 20 and 50 shown in FIGS. 4-6 while continuing to practice the principles and concepts of the invention to provide a current mirror circuit that is capable of operating with a low-voltage power supply. It should also be noted that the current mirror comprising PMOSs M4 25 and M5 26 is not limited with respect to the ratio of M4/M5 because the ratio has no impact on the number of output transistors that are used in the current mirror circuit. It should also be noted that the base current compensation provided by the feedback loop is independent of the number of output transistors that are used in the current mirror circuit. These features provide additional freedom in designing and constructing the current mirror circuit.

It should be noted that the invention has been described with reference to a few illustrative embodiments for the purposes of describing the principles and concepts of the invention. As will be understood by persons of skill in the art in view of the description being provided herein, the invention is not limited to these illustrative embodiments and that a variety of modifications can be made to the illustrative embodiments and that all such modifications are within the scope of the invention.

What is claimed is:

1. A low-voltage current mirror circuit comprising:

at least a first power supply voltage source supplying a supply voltage to the current mirror circuit;

an input stage electrically coupled to the power supply voltage source, the input stage comprising at least a current source and a first transistor;

an output stage having an input node that is electrically coupled to an output node of the input stage, the output stage comprising a second transistor that operates as a first current mirror to the first transistor;

a three-terminal voltage controlled current source (VCCS) having a first terminal, a second terminal and a third terminal, the first terminal of the VCCS being electrically coupled to the input stage, the second terminal of the VCCS being electrically coupled to ground; and a feedback loop electrically coupled on a first end to the third terminal of the VCCS and on a second end to the output and input nodes of the input and output stages, respectively, the feedback loop including a second current mirror that provides a compensation current to the output and input nodes of the input and output stages, respectively.

2. The current mirror circuit of claim 1, wherein the second current mirror comprises third and fourth transistors each having a first terminal, a second terminal and a third terminal, the first terminals of the third and fourth transistors being electrically coupled together, the third terminals of the third and fourth transistors being electrically coupled to the power supply voltage source, the second terminal of the third transistor being electrically coupled to the third terminal of the VCCS, the second terminal of the fourth transistor being electrically coupled to the output and input nodes of the input and output stages, respectively.

3. The current mirror circuit of claim 2, wherein the first and second transistors are first and second bipolar junction transistors (BJTs).

4. The current mirror circuit of claim 3, wherein the VCCS is a fifth transistor having a first terminal, a second terminal and a third terminal, the first terminal of the fifth transistor being electrically coupled to the input stage, the second terminal of the fifth transistor being electrically coupled to ground, the third terminal of the fifth transistor being electrically coupled to the first end of the feedback loop.

5. The current mirror circuit of claim 4, wherein the fifth transistor is an n-type metal oxide semiconductor field effect transistor (NMOS), the first terminal, the second terminal and the third terminal of the NMOS corresponding to a base, a source and a drain, respectively, of the NMOS.

6. The current mirror circuit of claim 5, wherein the third and fourth transistors are third and fourth p-type MOSs (PMOSs), the first, second and third terminals of each PMOS corresponding to a base, drain and source, respectively, of the respective PMOS.

7. The current mirror circuit of claim 1, wherein the power supply voltage source supplies a supply voltage that is less than or equal to about 1.5 volts (V).

8. The current mirror circuit of claim 7, wherein the power supply voltage source supplies a voltage that is less than or equal to about 1.2 volts (V).

9. A current mirror circuit comprising:

at least a first power supply voltage source supplying a supply voltage;

a current source having first and second terminals, the first terminal being electrically coupled to the first power supply voltage source;

a first transistor having a first terminal, a second terminal and a third terminal, the first terminal of the first transistor being electrically coupled to the second terminal of the current source;

a second transistor having a first terminal, a second terminal and a third terminal, the second terminal of the second transistor being electrically coupled to the second terminal of the first transistor;

a first capacitor having a first terminal that is electrically coupled to the second terminal of the first transistor and a second terminal that is electrically coupled to the first terminal of the first transistor;

a three-terminal device having a first terminal, a second terminal and a third terminal, the first terminal of the three-terminal device being electrically coupled to the first terminal of the first transistor, the second terminal of the three-terminal device being electrically coupled to ground; and a feedback loop, a first end of the feedback loop being electrically coupled to the third terminal of the three-terminal device, a second end of the feedback loop being electrically coupled to the second terminals of the first and second transistors, the feedback loop including a current mirror that provides a compensation current to the second terminals of the first and second transistors.

10. The current mirror circuit of claim 9, wherein the current mirror of the feedback loop comprises third and fourth transistors each having a first terminal, a second terminal and a third terminal, the first terminals of the third and fourth transistors being electrically coupled together, the third terminals of the third and fourth transistors being electrically coupled to the power supply voltage source, the second terminal of the third transistor being electrically coupled to the third terminal of the three-terminal device, the second terminal of the fourth transistor being electrically coupled to the second terminals of the first and second transistors.

11. The current mirror circuit of claim 10, wherein the first and second transistors are first and second bipolar junction transistors (BJTs), and wherein the first, second and third terminals of the first BJT correspond to a collector, a base and an emitter, respectively, of the first BJT, and wherein the first, second and third terminals of the second BJT correspond to a collector, a base and an emitter, respectively, of the second BJT.

12. The current mirror circuit of claim 11, wherein the three-terminal device comprises a voltage controlled current source (VCCS) having a gain, $g_m$.

13. The current mirror circuit of claim 12, wherein the VCCS comprises a third BJT, the first terminal, the second terminal and the third terminal of the third BJT corresponding to a base, an emitter and a collector, respectively, of the third BJT.

14. The current mirror circuit of claim 11, wherein the three-terminal device comprises a first metal oxide semiconductor field effect transistor (MOS), the first terminal, the second terminal and the third terminal of the first MOS corresponding to a base, a source and a drain, respectively, of the first MOS.

15. The current mirror circuit of claim 14, wherein the first MOS is an n-type MOS (NMOS), and wherein the third and fourth transistors are third and fourth p-type MOSs (PMOSs), the first, second and third terminals of each PMOS corresponding to a base, drain and source, respectively, of the respective PMOS.

16. The current mirror circuit of claim 11, wherein a voltage difference between the collector and emitter of the first BJT is about 0.5 V to about 0.7 V.

17. The current mirror circuit of claim 11, further comprising:

first and second resistors, the first resistor having a first terminal that is connected to the emitter of the first BJT and having a second terminal that is connected to ground, the second resistor having a first terminal that is connected to the emitter of the second BJT and having a second terminal that is connected to ground.

18. The current mirror circuit of claim 10, further comprising a capacitor having a first terminal that is electrically coupled to the first terminal of the first transistor and a second terminal that is electrically coupled to the second terminals of the first and second transistors.

19. The current mirror circuit of claim 9, wherein the power supply voltage source supplies a voltage that is less than or equal to about 1.5 volts (V).

20. The current mirror circuit of claim 19, wherein the power supply voltage source supplies a voltage that is less than or equal to about 1.2 volts (V).

21. The current mirror circuit of claim 19, wherein a voltage difference between the second and third terminals of the three-terminal device is in a range of about 0.5 V to about 0.7 V.

22. A method for enabling a current mirror circuit to operate using a relatively low-voltage power supply, the method comprising:

with at least a first power supply voltage source, supplying a supply voltage to the current mirror circuit, the current mirror circuit comprising an input stage, an output stage and a feedback loop, the input stage being electrically coupled to the power supply voltage source and comprising at least a current source and a first transistor, the output stage having an input node that is electrically coupled to an output node of the input stage, the output stage comprising a second transistor that operates as a first current mirror to the first transistor; and with a feedback loop electrically coupled to the output node of the input stage and to the input node of the output stage, providing a compensation current to the output and input nodes of the input and output stages, respectively, the feedback loop including a three-terminal voltage controlled current source (VCCS) and a second current mirror, the three-terminal VCCS having a first terminal, a second terminal and a third terminal, the second current mirror having a first terminal, a second terminal and a third terminal, the first terminal of the VCCS being electrically coupled to the input stage, the second terminal of the VCCS being electrically coupled to ground, the third terminal of the VCCS being electrically coupled to the first terminal of the second current mirror, the second terminal of the second current mirror being electrically coupled to said at least a first power supply voltage source, the third terminal of the second current mirror being electrically coupled to the output and input nodes of the input and output stages, respectively, for providing the compensation current from the feedback loop to the output and input nodes of the input and output stages, respectively.

23. The method of claim 22, wherein said at least a first power supply voltage source supplies a supply voltage that is less than or equal to about 1.5 volts (V).

24. The method of claim 23, wherein said at least a first power supply voltage source supplies a supply voltage that is less than or equal to about 1.2 volts (V).

25. The method of claim 22, wherein said at least a first power supply voltage source comprises at least first and second power supply voltage sources, the first power supply voltage source supplying a first supply voltage to the input stage and the second power supply voltage source supplying a second supply voltage to the second current mirror.

26. The method of claim 25, wherein the first and second supply voltages are the same.

27. The method of claim 25, wherein the first and second supply voltages are different.

* * * * *